United States Patent [19]

Astolfi

[11] Patent Number: 4,776,117

[45] Date of Patent: Oct. 11, 1988

[54] PICTURE FRAME WITH TABLE-TOP SUPPORT ELEMENT

[75] Inventor: Pietro Astolfi, Bologna, Italy

[73] Assignee: Pico-Glass S.p.A., Italy

[21] Appl. No.: 823,046

[22] Filed: Jan. 27, 1986

[30] Foreign Application Priority Data

Apr. 9, 1985 [IT] Italy ..... 4847/85[U]

[51] Int. Cl.[4] ..... G09F 1/12

[52] U.S. Cl. ..... 40/152.1; 248/473

[58] Field of Search ..... 40/152.1, 152, 124.1; 248/441 R, 473

[56] References Cited

U.S. PATENT DOCUMENTS

| | | | |
|---|---|---|---|
| 560,465 | 5/1896 | Bostwick | 40/152.1 X |
| 1,341,560 | 5/1920 | Johnson | 40/152.1 X |
| 2,276,776 | 3/1942 | Hofmann | 40/152 X |
| 2,630,992 | 3/1953 | Seelman | 40/152.1 X |
| 2,809,454 | 10/1957 | Maynard | 40/152.1 |
| 3,764,167 | 10/1973 | Longarzo | 40/152.1 X |
| 3,946,511 | 3/1976 | Wiener, Jr. | 40/152.1 |
| 4,229,892 | 10/1980 | Hueter et al. | 40/152.1 |
| 4,235,030 | 11/1980 | Astolfi | 40/152 |
| 4,422,613 | 12/1983 | Cray et al. | 40/152.1 X |

FOREIGN PATENT DOCUMENTS

| | | | |
|---|---|---|---|
| 893829 | 11/1944 | France | 40/152.1 |
| 1310444 | 10/1962 | France | 40/152.1 |
| 2640642 | 3/1978 | Fed. Rep. of Germany | 40/152 |
| 527946 | 10/1940 | United Kingdom | 40/152.1 |

*Primary Examiner*—Gene Mancene
*Assistant Examiner*—J. Hakomaki
*Attorney, Agent, or Firm*—Darby & Darby

[57] ABSTRACT

A picture frame includes a back panel on which a photograph is placed and a transparent front panel adjacent to the photograph for protecting the photograph. The picture frame also includes a plurality of clips for securing the back panel, photograph and front member together. The frame also includes a groove formed in an inside edge, the groove being dimensioned to receive the clips. A support element for the picture frame includes a substantially U-shaped lower part which is received by the groove formed in the picture frame and a rear extension member which is joined to and extends from the lower part. The lower part includes a curved front wing portion and a curved back wing portion, the curved front wing portion including a protrusion which is adapted to rest against the inside edge of the frame.

1 Claim, 1 Drawing Sheet

PICTURE FRAME WITH TABLE-TOP SUPPORT ELEMENT

BACKGROUND OF THE INVENTION

1. Field of the Invention

The present invention relates to a picture frame with table-top support element. The above fits into the category of normal practical-economical frames, or rather those frames already pre-assembled and easy to use by the user.

2. Description of the Prior Art

The structure of these frames is composed of a closed frame, an element or back board on which is positioned the image or photograph to be shown and lastly, at the front, a protective glass. The said above-mentioned elements are held firmly to the frame by means of a number of securing clips around the edge.

In the majority of cases such frames are hung on walls by means of one of the said clips and for which no support is necessary: some solutions have used, for reaching the objective in question, an arm extended from the back of the frame itself, more specifically from the back board to the surface on which the frame is placed, said arm normally being hinged to the said back board with the possibility of closing it flat. It is evident that such frames present inconveniences of an economical and functional point of view which prejudicate in part their use : economic in the sense that the possibility of hanging it on the wall necessarily brings about an increase in the assembly costs during production, and from a functional point of view in as much as the attachment of an arm to the back board is not the most stable and secure, the latter being thin and often made of material which is not very durable.

OBJECTS AND SUMMARY OF THE INVENTION

The objective of the present is that of avoiding the problems mentioned above by realizing a table-top support element for picture frames which can be applied directly by the user and thus does not affect the overall cost of the frame and which also imitates the form of the securing clips without in any way altering the esthetic effect of the frame and thus using the practicality and function of the same.

For this purpose it is an important aim of the present mode of use to conceive an element with a simple structure, economical, and easy to make by the industries of the sector.

These objectives and others which are better described further on, are reached by the picture frame in question comprised of at least a back panel supporting the image and at least a glass at the front covering the image and providing protection, said frame also having a number of clips arranged around the inner edge of the same so as to maintain in a stable position by reciprocally blocking the said elements mentioned above, characterized by the fact that at least one of the said clips, acting as the support element has, in relation to the back, an extension developing substantially in a right-angled direction to the said panel.

Further characteristics and advantages will result more apparent from the detailed description which follows of a form of execution of the preferred frame in question, illustrated in an indicative manner and not limited to the ambit of the design of which:

Figure 1:
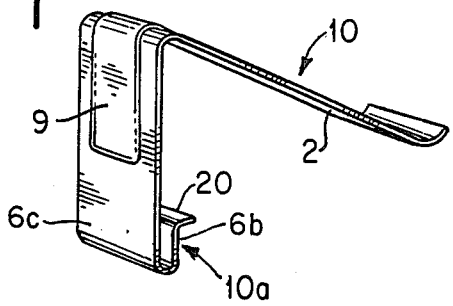
FIG. 1 shows a perspective view of the support element in question.

With reference to the attached drawings, the number 4 indicates a picture frame with table-top support element 10. Said frame 4, of the type already noted, is comprised of a closed frame 1, a back panel 3 on which the image 7 is placed and a glass 5 which closes and protects; the frame 1 has, at the front, a ledge against which the above-mentioned elements are pressed and secured. To block the above-mentioned elements glass 5, image 7 and back panel 3 to the frame 1, are employed several normal clips 6 arranged as can be seen from FIG. 2, around the edge of the frame 4 and symetrically to one another on each side, inserted with a press and push movement into one of the corresponding grooves 1*a* made longitudinally along the frame 1 and pointing towards the inside of the same; the groove 1*a* has a tooth 1*b* and the clip has a corresponding tooth 6*a*.

Figure 2:
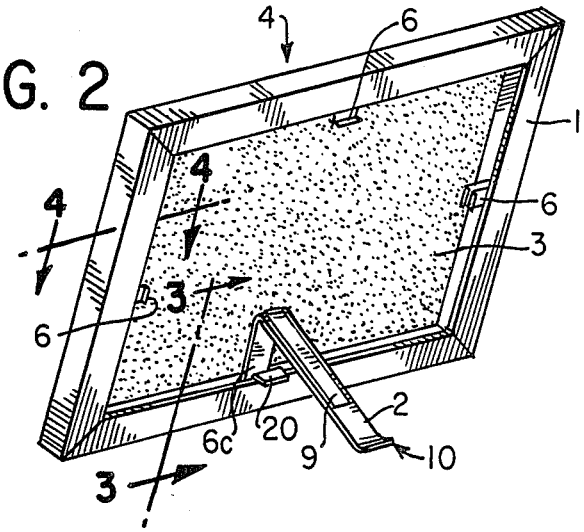
FIG. 2 shows a perspective view of the back of the frame to which has been applied the support element shown in FIG. 1.

The clips thus constitute a series of checking elements which hold together all the elements (glass, image and panel) in a stable position as shown in FIG. 2.

The invention in question proposes using at least one of the said clips 6 and making it in such a way as to constitute a table-top support element 10 for the frame 4. In this case the clip 6 has, as can be seen in FIG. 1, an extension 2, which develops substantially in a right-angled direction to the panel 3 and consequently to the frame 4.

In other words the clip which acts as a support element 10 has the lower part 10*a* shaped more or less like a "U", which is inserted into the groove 1*a* of the frame with the front wing 6*b* free, (curved and finishing with a protrusion 20 which rests against the frame's edge), in height inferior to the remaining back wing 6*c*, the latter developing towards the centre of the frame 4 (and consequentially towards and against the back panel 3 up until a certain height), at which point developing into said extension 2 of the support element 10.

Figure 3:
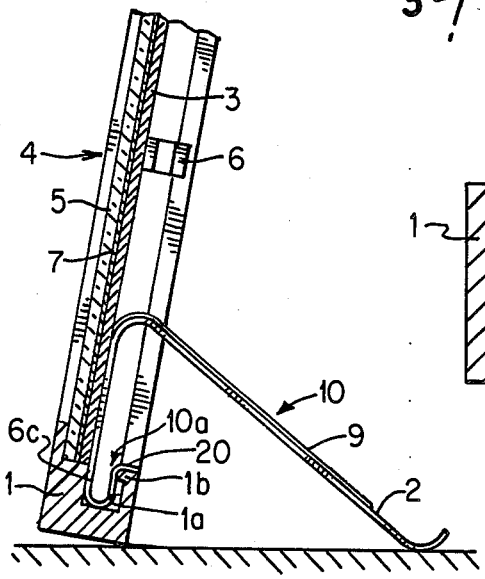
FIG. 3 shows a partial transversal section of FIG. 2.
Figure 4:
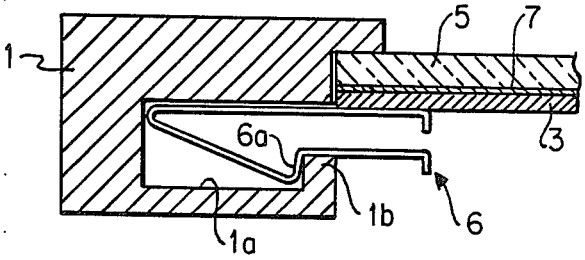
FIG. 4 shows a fragmentary sectional view taken through the frame 1 at the location of the right hand clip 6 in FIG. 2.

Furthermore, the latter is made with a reinforced rib 9 developed longitudinally and, at the free end, by a slight upwards curve (as shown in FIGS. 1, 2 and 3.) to favour the resting of the frame on the table.

The invention therefore meets the objectives already laid down, in as much as said support element is economical, durable, and above all uses the shape of a standard clip, without in any way altering the final esthetic appearance. The last but not least advantage arises from the fact that said support element 10 brings about a reduction in the time required to mount the same on to the frame in respect of preceding supports available in commerce, and in such case it will be the user himself who can choose the use of the frame; to hang it on a wall or put it on a table, mounting the same by a standard clip or one or more of the support elements by a simple operation.

The invention when made can also assume in practice other forms from that illustrated above, in particular numerous modifications of a practical nature can be realised, without going outside of the ambit of protection for the present invention.

In practice the materials used, the shape and dimensions can be varied according to requirements.

I claim:

1. A combination, comprising:

a picture frame having a back panel on which a photograph is placed and a transparent front member adjacent to the photograph for protecting the photograph, the picture frame further including a plurality of clips mounted on the frame about the peripheral edge thereof in order to secure the back panel, photograph and front member together, the frame having an inside edge defining the perimeter of a rear frame opening conforming substantially in size and shape to said back panel, the frame further having a groove formed in the inside edge thereof, the groove being opened towards the inside of the frame, the groove being dimensioned to at least partially receive and retain the clips; and a support element for the picture frame, the support element having a substantially U-shaped lower part, dimensioned to be received and retained by the groove formed in the picture frame, the U-shaped lower part being formed of and including a curved front wing portion and a curved back wing portion, the curved rear wing portion including a protrusion extending rearwardly so as to press against the inside edge of the frame, the front wing portion extending into said rear frame opening in pressing engagement with the back panel, the support element further including a rear extension member joined to and extending from said front wing portion of the U-shaped lower part, the rear extension member including a free curved end, and a longitudinal reenforcing rib extending along said front wing portion and said rear extension.

* * * * *